US005566620A

United States Patent [19]

Siewert

[11] Patent Number: 5,566,620

[45] Date of Patent: Oct. 22, 1996

[54] LEVITATED RAIL SYSTEM

[76] Inventor: Bradley D. Siewert, 1401 Stonebridge Way, Roseville, Calif. 95661

[21] Appl. No.: 559,335

[22] Filed: Nov. 16, 1995

[51] Int. Cl.[6] ..... E01B 25/00

[52] U.S. Cl. ..... 104/124; 104/23.2; 104/138.1

[58] Field of Search ..... 104/23.1, 23.2, 104/124, 125, 126, 138.1

[56] References Cited

U.S. PATENT DOCUMENTS

| | | | |
|---|---|---|---|
| 3,111,093 | 11/1963 | Jay . | |
| 3,534,689 | 10/1967 | Barthalon | 104/23.1 |
| 3,543,685 | 5/1968 | Rosciszewski | 104/23.2 |
| 3,623,434 | 11/1971 | Jarvis . | |
| 3,722,424 | 3/1973 | Van Veldhuizen . | |
| 3,885,505 | 5/1975 | Winkle et al. . | |
| 3,919,947 | 11/1975 | Simon et al. | 104/124 |
| 3,937,149 | 2/1976 | Winkle et al. . | |
| 3,938,445 | 2/1976 | Hughes | 104/124 |
| 4,029,019 | 6/1977 | Watkins | 104/124 |
| 5,152,227 | 10/1992 | Kato . | |
| 5,253,592 | 10/1993 | Coffey . | |
| 5,460,098 | 10/1995 | Jackson et al. | 104/124 |

FOREIGN PATENT DOCUMENTS

| | | | |
|---|---|---|---|
| 1405547 | 1/1969 | Germany . | |
| 3640779 | 10/1987 | Germany | 104/138.1 |
| 3924486 | 1/1991 | Germany . | |
| 6-191402 | 7/1994 | Japan | 104/138.1 |

*Primary Examiner*—Mark T. Le
*Attorney, Agent, or Firm*—John P. O'Banion

[57] ABSTRACT

A levitated rail system for vehicle transportation utilizing a plurality of cylindrical, tubular rails. Freight capsules may be transported within the hollow interiors of the rails. One or more cars travel at high speed above two of the rails by levitation.

15 Claims, 10 Drawing Sheets

LEVITATED RAIL SYSTEM

BACKGROUND OF THE INVENTION

1. Field of the Invention

This invention pertains generally to rail systems for trains and like vehicles, and more particularly to a levitated rail system with cylindrical, tubular rails for use with air-cushion levitated or magnetically levitated trains.

2. Description of the Background Art

Rail-based transportation systems are increasingly used by commuters, tourists, and other persons for travel within cities and between cities. Rail systems of various configurations and arrangements have been devised for such transportation in which cars or vehicles are suspended from an overhead rail or rails, as well as systems in which a rail or rails support cars from beneath. The advent of magnetically levitated and air levitated trains has led to the development of a variety of high speed rail systems.

With few exceptions, previously disclosed rail systems rely on rails or guide ways having generally flat-surfaced or rectangular-shaped rails. High speed vehicles experience relatively high aerodynamic lift forces in association with such rails which constrain the vehicles in both speed and suspension characteristics. Additionally, conventional rail systems tend to experience high static wind loads in external winds, thereby requiring additional support for the rail systems which would otherwise not be required. Further, the background art rails and guide-ways are generally structured so that rain, snow, or debris may collect on flat surfaces, reducing vehicle speeds and creating the risk of damage to the vehicle and to the track.

Accordingly, there is a need for a levitated rail system wherein unfavorable aerodynamic lift forces are minimized, which experiences reduced static wind loads, and which employs rails upon which snow, rain, or other material does not accumulate. The present invention satisfies these needs, as well as others, and generally overcomes the deficiencies found in the background art.

The foregoing reflects the state of the art of which the applicant is aware and is tendered with the view toward discharging applicant's acknowledged duty of candor in disclosing information which may be pertinent in the examination of this application. It is respectfully stipulated, however, that none of this information teaches or renders obvious applicant's claimed invention.

SUMMARY OF THE INVENTION

This invention is directed to a levitated rail system for vehicle transportation which, in general terms, comprises a plurality of cylindrical, tubular, parallel rails or guide ways, with each rail coupled to each other rail by support means, and base means for supporting at least one of the rails from the ground. By way of example, and not of limitation, the plurality of rails generally includes at least two parallel rails, and preferably comprises first, second, and third hollow, parallel rails of cylindrical cross section. Preferably, the third rail is positioned between the first and second rails and generally below the first and second rails. Support means, preferably in the form of a plurality of struts, connect or couple the first rail to the second rail, the first rail to the third rail, and the second rail to the third rail, so that a generally triangular cross-section is imparted to the rail system, with the third rail located at the bottom apex. Base means, which preferably comprise a plurality of base supports or pillars, are coupled to the third rail and support the rail system from the ground. The preferred rail configuration of the invention provides a rail system of particularly stable and solid structure for overhead train and tram systems, and allows reduced static wind loads and reduced aerodynamic lift forces associated with the rails. A catwalk or walkway may also be included between the first and second rails.

The present invention takes advantage of the space within the interior of the hollow rails, which has heretofore not been utilized, by employing the rails as means for delivering capsules or packets along the rail line by driving or transporting the capsules within the hollow interior of one or more rails. Preferably, a pressurized fluid such as water or compressed air is employed for driving or transporting the capsules. Alternatively, other power sources such as linear induction could be employed for driving or transporting the capsules. Generally, at least two of the rails of the invention are used for transporting freight or mail capsules, so that the capsules may be sent in both directions at the same time through the hollow interiors of different rails.

Generally, at least one car is included with the invention, with the car being structured and configured to ride upon the first and second rails. Air cushion means for supporting or levitating the car on the first and second rails is included with the car, preferably in the form of elongated, resilient plenums which are structured and configured to engage the first and second rails, and supply a layer of air between the car and the rails.

An object of the invention is to provide a levitated rail system having a plurality of hollow, cylindrical, tubular rails. Another object of the invention is to provide a levitated rail system which reduces undesirable aerodynamic lift forces associated with the rails.

Another object of the invention is to provide a levitated rail system which reduces static wind loads on the rail system.

Another object of the invention is to provide a levitated rail system which may be used for transportation of packets or capsules within the hollow interiors of the rails.

Another object of the invention is to provide a levitated rail system of light weight and high structural integrity which requires reduced external support.

Further objects of the invention will be brought out in the following portions of the specification, wherein the detailed description is for the purpose of fully disclosing the invention without placing limits thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
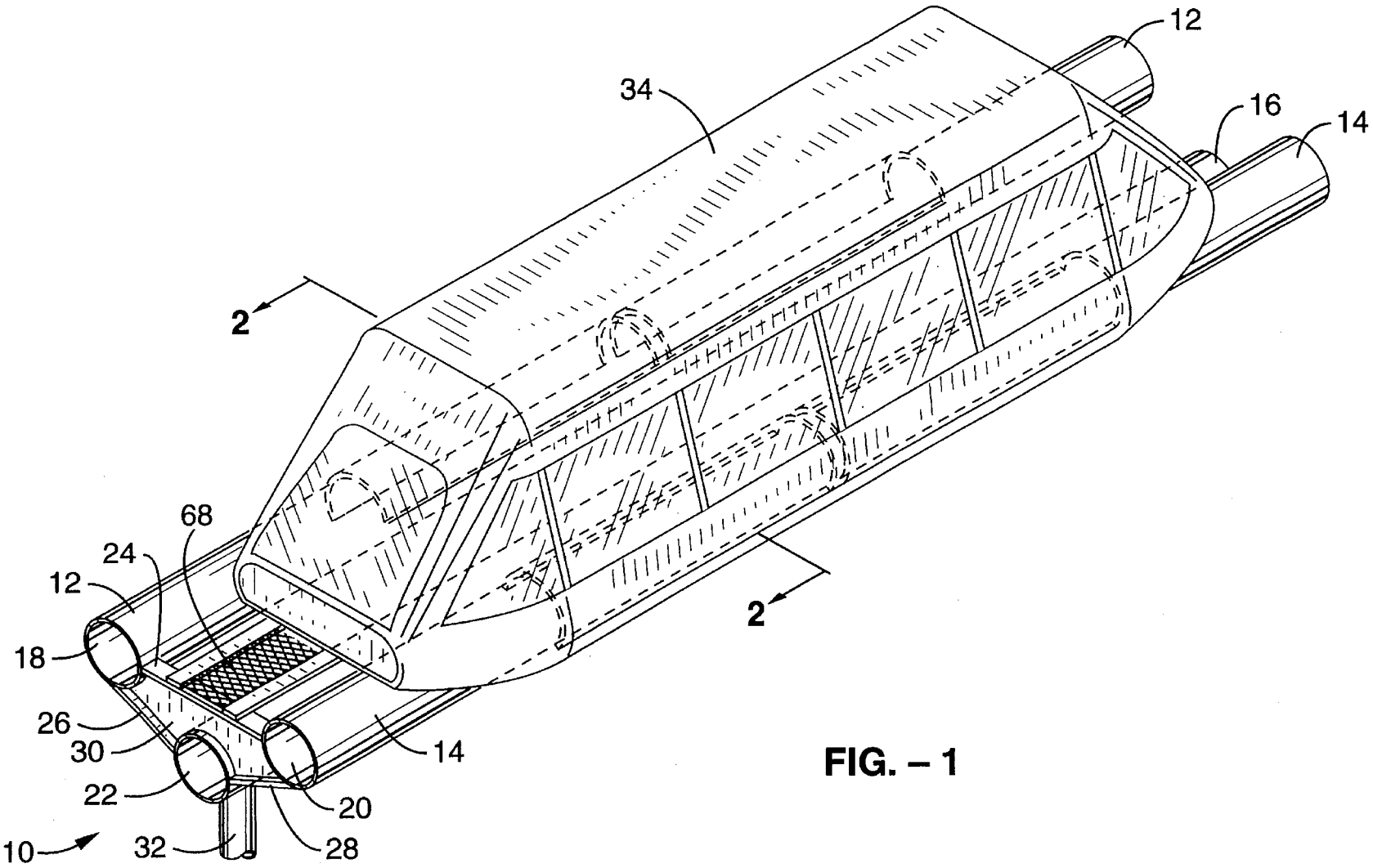
FIG. 1 is a perspective view of a levitated rail system in accordance with the present invention, showing a rail car on the rails.

Referring more specifically to the drawings, for illustrative purposes the present invention is embodied in the rail system which is generally shown in FIG. 1 through FIG. 13, where the reference numerals denote like parts. It will be appreciated by persons of ordinary skill in the art that the rail system comprising the present invention may vary as to configuration and as to details without departing from the basic concepts as disclosed herein.

Referring first to FIG. 1 through FIG. 8, there is shown a preferred embodiment of the levitated rail system 10 comprising the present invention. A plurality of hollow, tubular, parallel rails or guide ways of generally cylindrical cross-section are included with the invention, and preferably comprise a first rail 12, a second rail 14, and a third rail 16. Rails 12, 14, 16 each have a hollow interior 18, 20, 22 respectively. Generally, the third rail 16 is positioned between first and second rails 12, 14, and third rail 16 is positioned slightly below or beneath first and second rails 12, 14, so that rails 12, 14, 16 form an assembly of triangular cross section, with third rail 16 located at the lower apex. Rails 12, 14, 16 are preferably made of a high strength steel alloy.

The cylindrical shape of rails 12, 14, 16 prevents rain, snow, or other material from collecting or accumulating on top of rails 12, 14, 16 which would impede travel along the rails or result in damage to a rail car or vehicle. The cylindrical shape of the rails of the present invention also minimizes the static wind load experienced by the rail system 10 when exposed to external winds.

The present invention also comprises support means for coupling or connecting each of the plurality of rails to each other. The support means generally comprises a plurality of struts 24 which couple first and second rails 12, 14 together, a plurality of struts 26 which couple first and third rails 12, 16 together, and a plurality of struts 28 which couple second and third rails 14, 16 together. A solid plate or gusset 30 may be employed in association with struts 24, 26, 28, to provide further support to the rail system of the present invention. The arrangement of struts 24, 26, 28 and plate 30 as shown in FIG. 1 through FIG. 8 is but one of many possible support means which may be used to couple first, second, and third rails 12, 14, 16 together. A variety of arms, struts, or other load bearing members of varying structures and configurations may be employed for support means with rail system 10, as will be readily apparent to persons of ordinary skill in the art.

Base means for supporting the plurality of rails are also included with the invention, and preferably comprise a plurality of base members or pillars 32 which are coupled to or otherwise configured in supporting association with third rail 18. Base members 32 are suitably positioned and spaced apart to provide support to third rail 16 and the overall rail system 10 from the ground. The hoop strength associated with cylindrical tubular rails 12, 14, 16 utilized by the present invention provides generally for light and strong rails, and allows larger spans in between base members 32.

Figure 2:
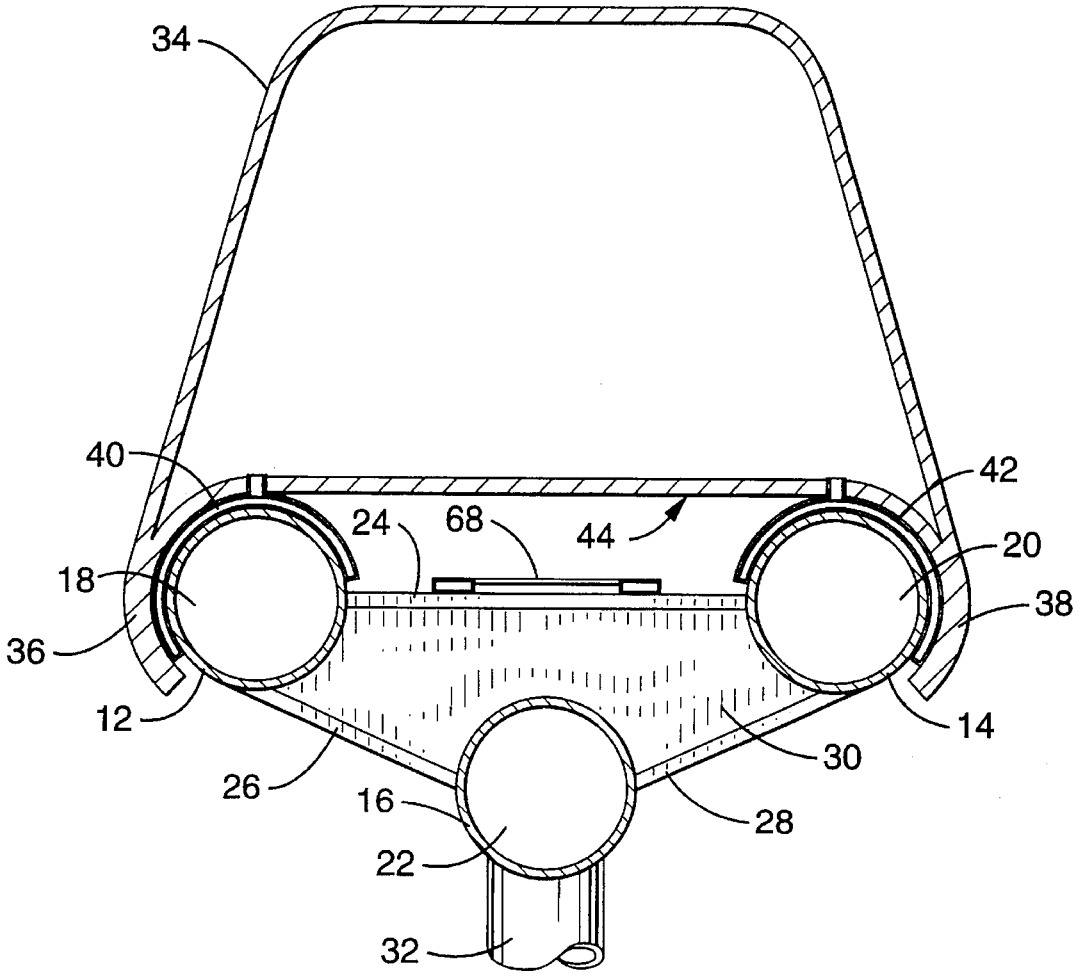
FIG. 2 is a cross-sectional view of the levitated rail system and rail car of FIG. 1 taken through line 2—2.

Generally, at least one car or vehicle 34 is included with the invention, which may be of any shape and dimensions aerodynamically suitable for rail travel. Car 34 is structured and configured to ride or travel on at least two of the plurality of rails of the rail system 10, which, as shown, are first and second rails 12, 14. As can be seen in FIG. 2, a pair of elongated, curved runners or lips 36, 38 are included on car 34, with runners 36, 38 structured and configured to partially encircle rails 12, 14 respectively to retain car 34 on rails 12, 14 during travel.

Figure 6:
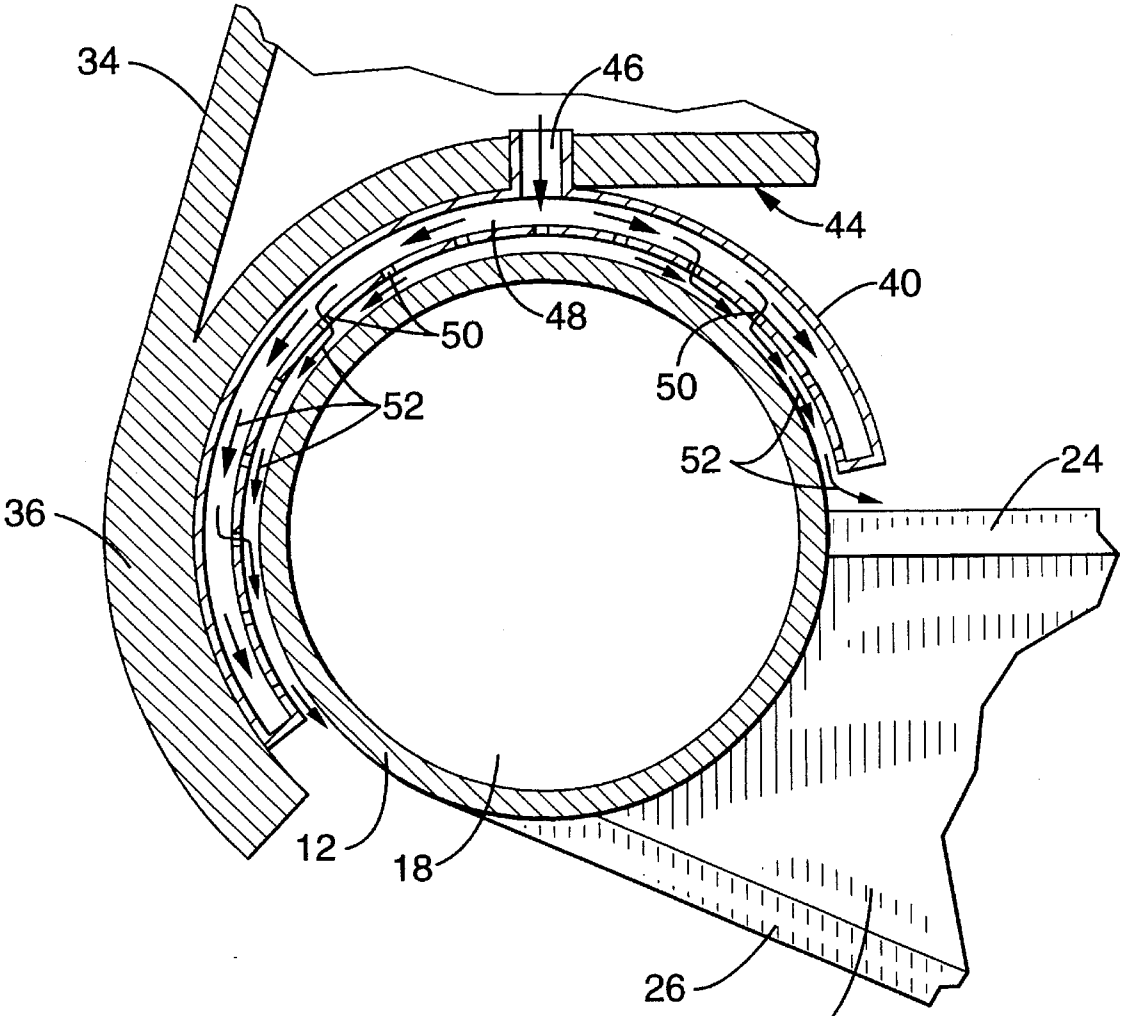
FIG. 6 is a detail view of the cross-section of FIG. 2 showing a resilient compressed air plenum.
Figure 7:
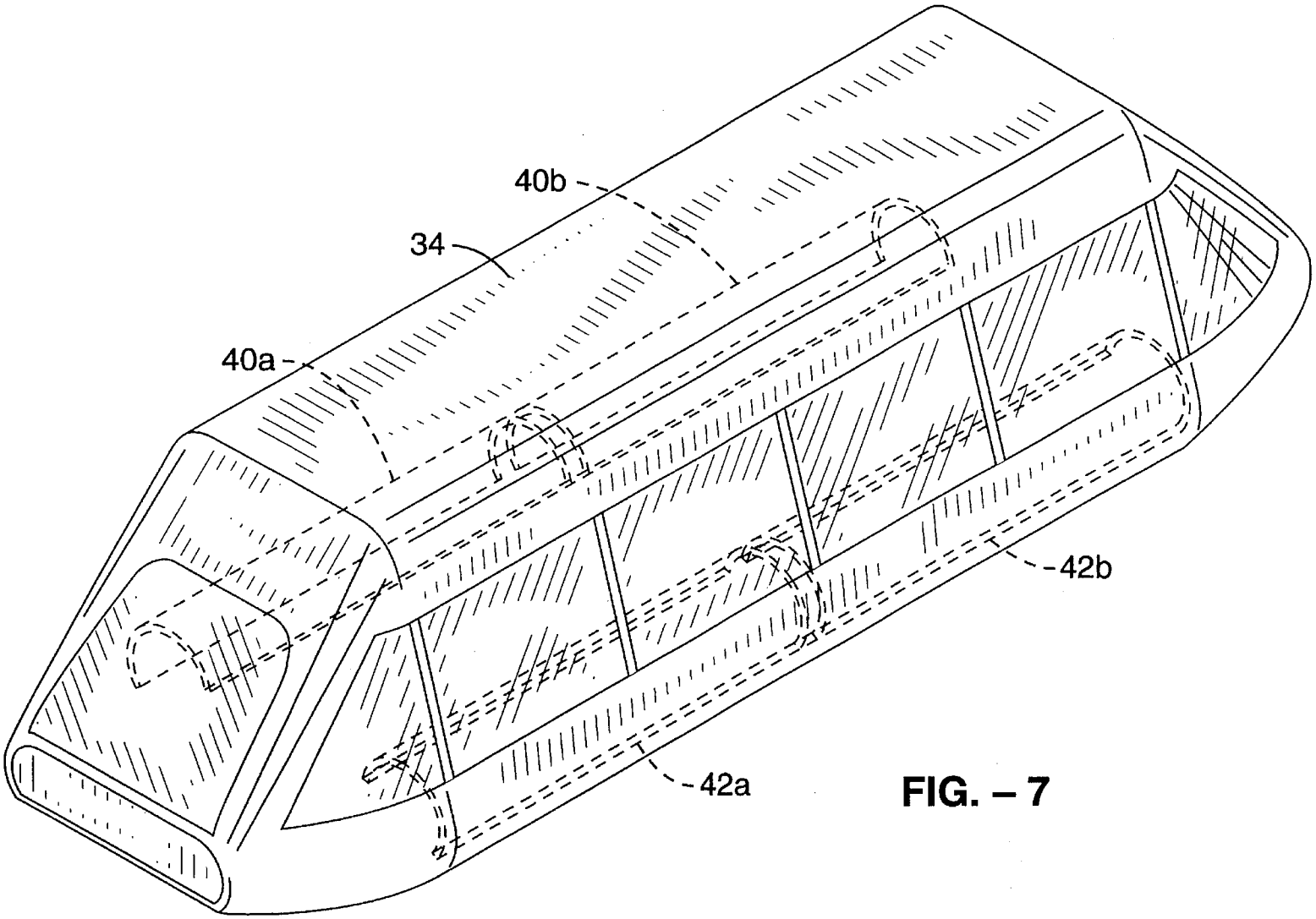
FIG. 7 is a perspective view of the rail car shown in FIG. 1.

Referring more particularly to FIG. 2 and FIG. 7, air cushion means for supporting car 34 on rails 12, 14 are generally included with the invention, and preferably comprise a pair of resilient plenums or air pods 40, 42 which are preferably divided into segments 40*a*, 40*b*, 42*a*, 42*b*. Plenums 40, 42 are associated with a bottom surface 44 and the runners 36, 38 of car 34 and coupled thereto by conventional means (not shown). Plenums 40, 42, are structured and configured to partially encircle first and second rails 12, 14, as seen most clearly in FIG. 2 and FIG. 6.

Referring more particularly to FIG. 6, the operation of the air cushion means of the invention is illustrated. Generally, compressed air from a jet- or natural gas-fueled turbine compressor or other compressed air source (not shown) which is on board car 34 is directed through conduit 46 into an interior channel 48 of plenum 40. The compressed air is then directed from the interior 48 of plenum 40 through a plurality of orifices or holes 50. The compressed air, which is illustrated by arrows 52, provides an air cushion upon which car 34 may travel at high speeds with relatively low friction. Car 34 itself is preferably powered by a linear induction motor or other conventional means (not shown) while riding on the air cushions provided by plenums 40, 42. Magnetic levitation means may also be utilized with the invention for levitating car 34.

Figure 3:
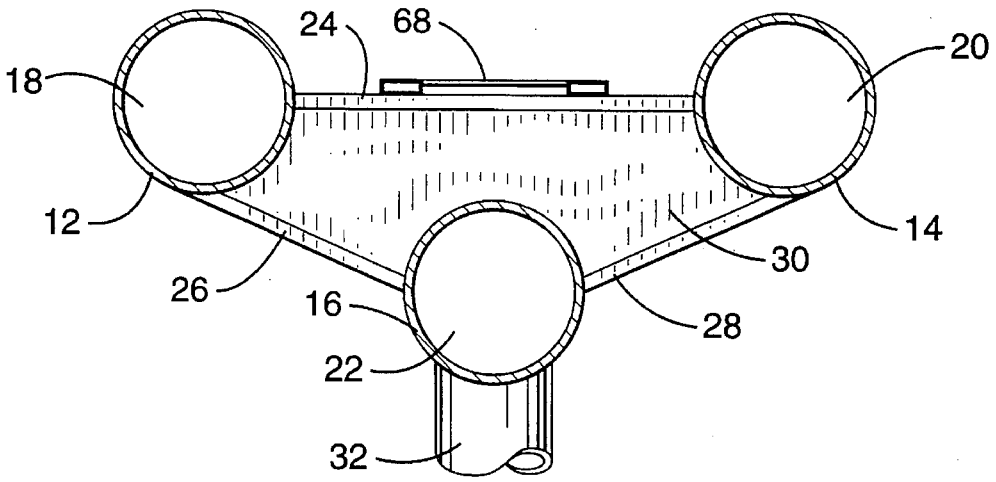
FIG. 3 is a cross-sectional view of the rail system shown in FIG. 2 with the rail car removed.
Figure 4:
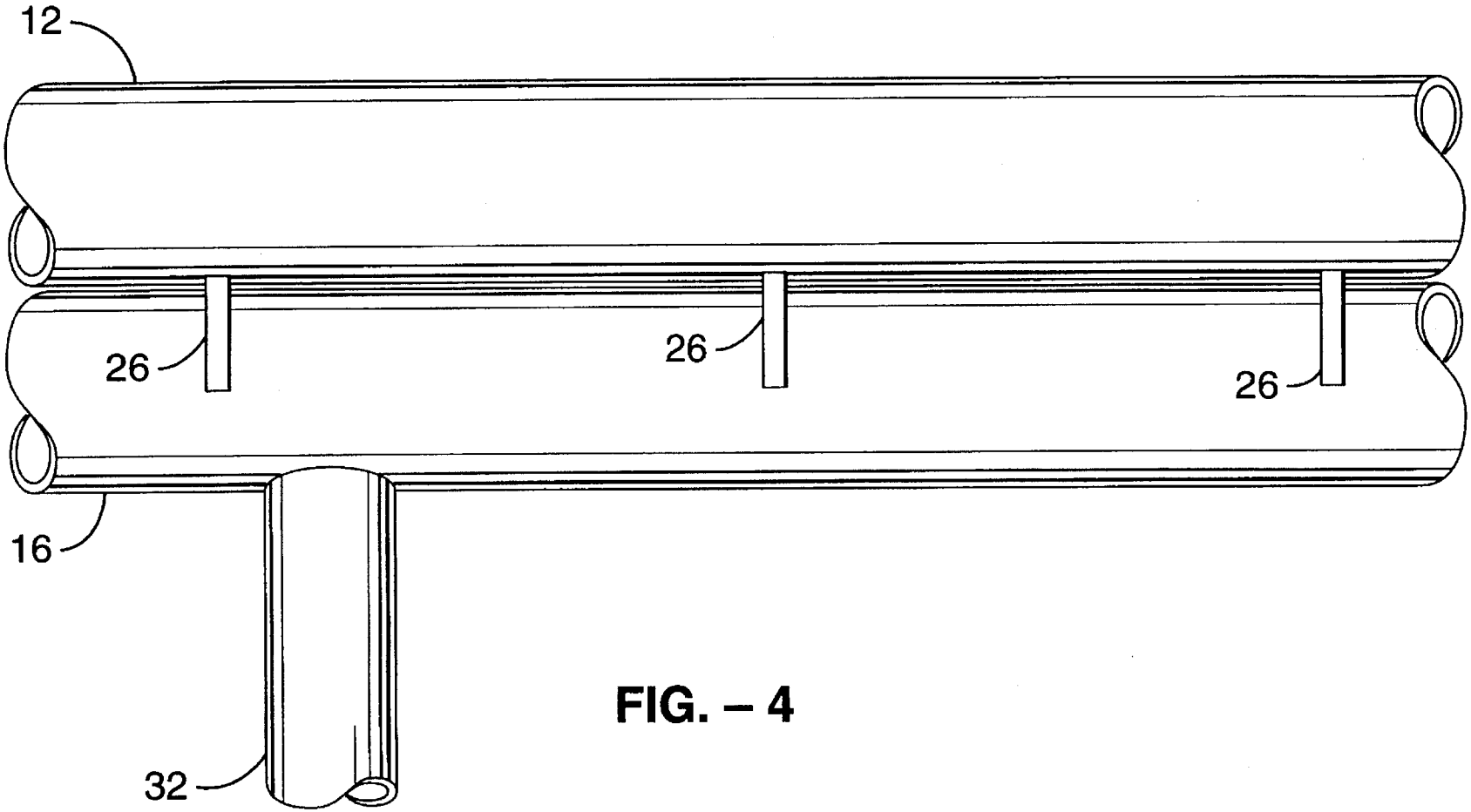
FIG. 4 is a side elevational view of the rail system shown in FIG. 3.
Figure 5:
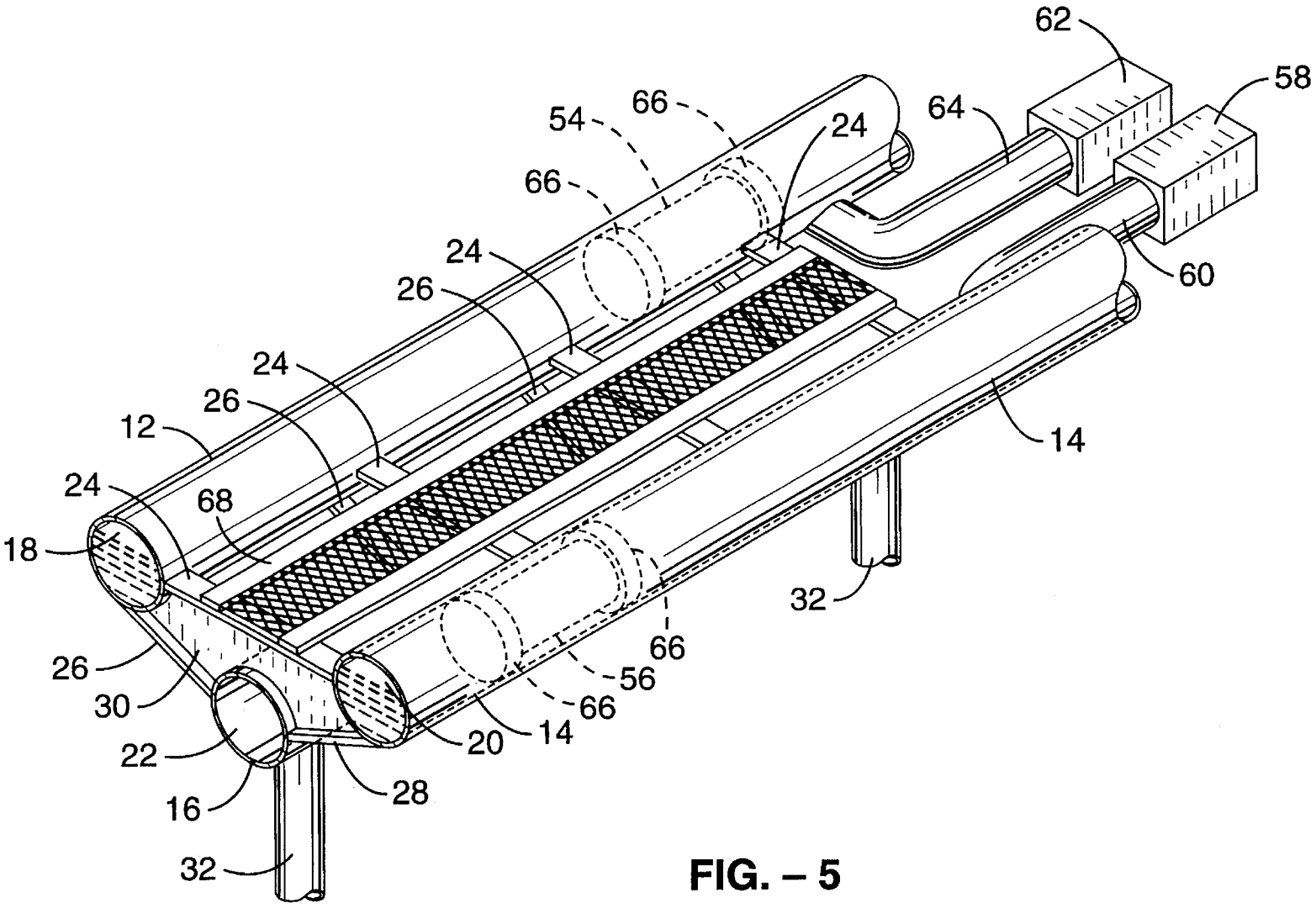
FIG. 5 is a perspective view of a levitated rail system in accordance with the invention, showing freight capsules within the rails and an air compressor and vacuum source in association with the rails.

Referring now to FIG. 5, one, or more capsules or packets 54, 56 for transporting freight, mail, or other items are preferably included with the rail system comprising the invention. Freight capsules 54, 56 are preferably of cylindrical structure and configuration such that capsules 54, 56 fit within the hollow interiors 18, 20, 22 of rails 12, 14, 16, respectively. In the preferred embodiment, at least two rails in the rail system are utilized for transporting capsules 54, 56, so that capsules 54, 56 may be simultaneously delivered in two directions along different rails. As shown in FIG. 3, first and second rails 12, 14 contain freight capsules 54, 56, respectively, within their respective hollow interiors 18, 20. Third rail 16 may also be utilized for transport of a freight capsule within its interior 22. Alternatively, the interior 22 of third rail 16 (or first or second rails 12, 14) may be employed to hold electric cables, water lines, compressed air lines, or like conduits (not shown) used with the rail system 10.

Transport means for driving freight capsules 54, 56 within rails 12, 14 are included with the invention, and preferably comprise pressurized fluid means for driving the capsules. The pressurized fluid means is associated with each rail wherein capsules are to be transported, and preferably comprises a water or compressed air supply located at one end of a rail or rail segment, and a pump or vacuum source located at the other end of a rail or rail segment, so that capsules 54, 56 may be driven by water or compressed air from behind and simultaneously drawn forward by pumping or vacuum. The compressed air supply is preferably a turbine compressor 58 which provides compressed air via tube 60 to the hollow interior 20 of second rail 14. A vacuum source 62, which is preferably a vacuum turbine, is shown associated with first rail 12 wherein vacuum is applied to the interior 18 of rail 12 via tube 64. Generally, another vacuum source (not shown) is included "downstream" or towards the capsule-receiving end of second rail 14, and another compressed air supply (not shown) is located "upstream" or towards the delivering or sending end of first rail 12. Where water is the transport fluid used with the invention, conventional pumps would be used instead of turbine compressor 58 and vacuum source 60.

Thus, in the arrangement shown in FIG. 5, freight capsule 56 is driven or transported within interior 20 of second rail 14 generally from right to left, with turbine compressor 58 providing air to drive capsule 56 towards a vacuum source (not shown). Likewise, freight capsule 54 is transported within interior 18 of first rail 12 generally from left to right, being driven by a compressed air source (not shown) towards vacuum source 62.

In using the rail system 10 for freight transport, loaded freight capsules 54, 56 would be introduced into the interior portions 18, 20 of rails 12, 14 by conventional means (not shown), and then compressed air would be introduced to the rail interiors 18, 20 behind capsules 54, 56, and vacuum would be applied to rail interiors 18, 20 in front of freight capsules 54, 56, so that freight capsules are driven or transported within the interiors 18, 20 of rails 12, 14. Upon reaching their destinations, the rail interiors 18, 20 are vented by conventional means (not shown) to return interiors 18, 20 to ambient pressure, and the capsules 54, 56 are then removed from rails 12, 14 and unloaded. In situations wherein capsules 54, 56 are to be transported distances along first and second rails 12, 14 which exceed the effective range of a single compressed air or fluid and/or a single vacuum source or there are junctions at which freight capsules are to be placed into or removed from the rails, the travel of the capsules may be made in segments as discussed further below, with each segment of rail traveled including a compressed air or fluid source to drive freight capsules and a vacuum source to draw freight capsules forward.

The pressurized fluid means for driving or transporting freight capsules 54, 56 generally comprises air or other gas which is both compressed and reduced in pressure by turbine compressors and vacuums, as related above. It is also contemplated, however, that compressed air or other gas may be used to drive capsules 54, 56 through rails 12, 14 and/or 16 without the use of vacuum sources. In such a situation, suitable venting means are used in association with the downstream or receiving end of the rail to allow removal of air displaced by the traveling freight capsules. Alternatively, capsules 54, 56 may be driven solely by vacuum applied at the receiving end of rail, without compressed air applied from behind the capsules 54, 56.

The pressurized fluid means may alternatively comprise pressurized water or other liquid, rather than air or gas, for transporting, driving or pushing capsules 54, 56 through the hollow interiors 18, 20, 22 of rails 12, 14, 16 of rail system 10. The pressurized water may be introduced into a rail interior behind a freight capsule by fluid pumps to drive the capsule forward, and/or fluid pumps ahead of the freight capsules are used to draw the capsules forward. After driving the capsules, the water would be drained from the rails by suitable means and retained for reuse in transporting subsequent freight capsules.

Freight capsules 54, 56 are preferably provided with seal means for preventing pressurized fluids such as air or water from escaping around freight capsules 54, 56 when traveling in the hollow interiors 18, 20 of rails 12, 14. Preferably, the seal means are rings or seals 66 of low friction coefficient material such as TEFLON® which has been machined for precision fitting within the interiors 18, 20 of first and second rails 12, 14.

Referring again to FIG. 1, preferably, a cat walk or walkway 68 is included between first and second rails 12, 14 and supported by struts 24 which hold first and second rails 12, 14 together. Cat walk 68 facilitates maintenance of rails system 10 and allows egress from car 34 in the event of power failure or other reason which may interrupt travel of car 34 on rails 12, 14. The pressurized fluid means for transporting freight capsules related above is preferably located below cat walk 68 and above third rail 16, allowing easy access from cat walk 68 for repair or maintenance.

Figure 8:
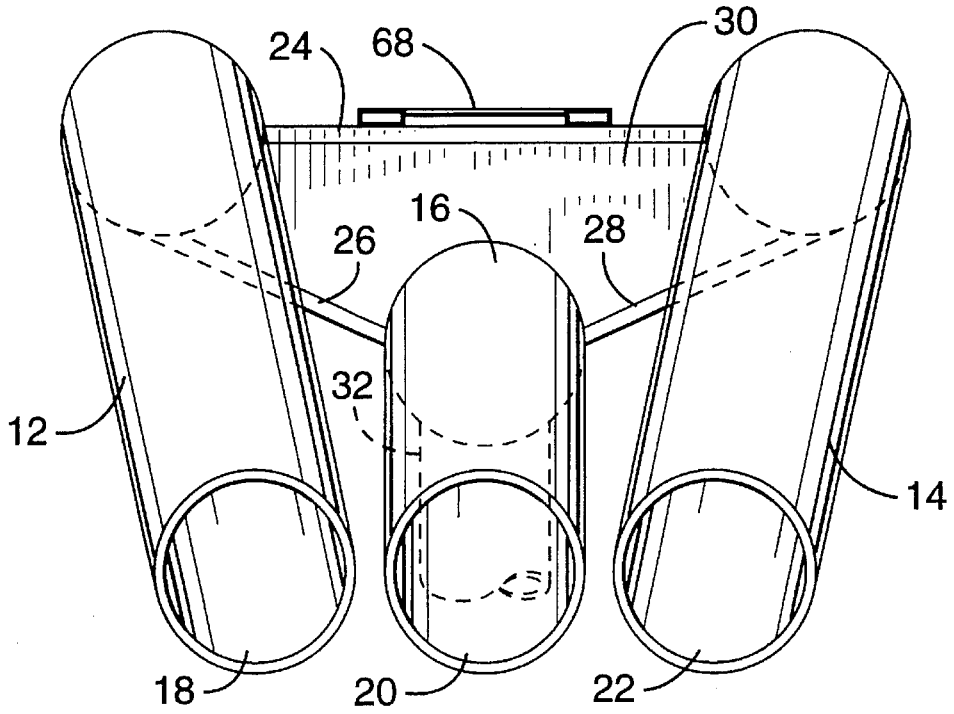
FIG. 8 is an end view of a terminal portion of the rail system in accordance with the invention.

Referring next to FIG. 8, there is shown an end view of the terminal portion of a rail system 10, with rails 12, 14, 16 generally curved or directed inward and downward, and generally brought together and directed into a terminal building (not shown) wherein freight loading, transfer, and unloading operations take place. The terminal portion of rail system 10 as shown in FIG. 8 is generally present at the ends of the rail system where freight capsules are injected into or removed from rail interiors. The injection and removal of freight capsules from rails 12, 14, 16 are discussed further below.

Figure 9:
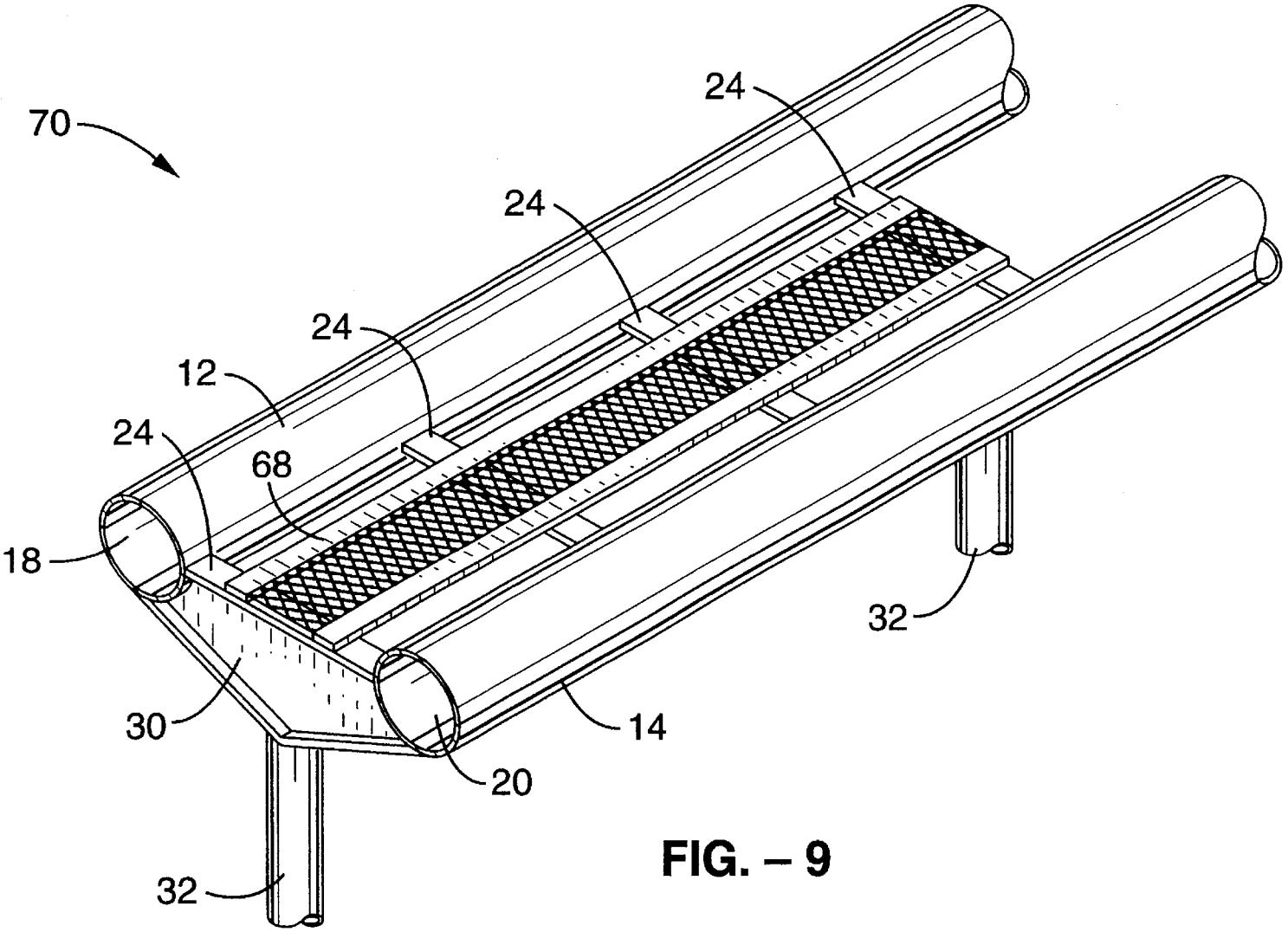
FIG. 9 is an alternative embodiment of the rail system comprising the present invention.

Referring now to FIG. 9, there is shown an alternate embodiment of a rail system 70 in accordance with the present invention, wherein like reference numerals denote like parts. In the embodiment of the invention shown in FIG. 9, the third rail and related struts have been omitted, and a car is not shown for reasons of clarity. In all other aspects, the rail system 70 is generally the same as the rail system 10 related above and operates in generally the same manner.

Figure 10:
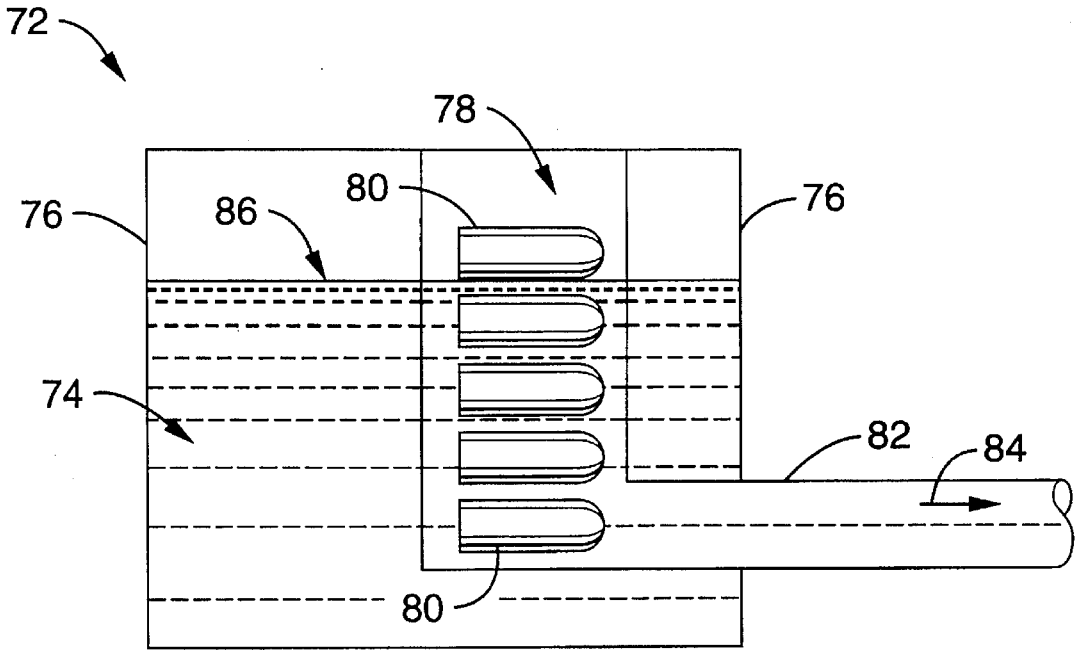
FIG. 10 is a diagrammatic side view of a terminal freight capsule injector system in accordance with the present invention.

Referring next to FIG. 10, there is shown a terminal injection system 72 for placing or injecting freight capsules into rails for transportation. Terminal injection system 72 includes a reservoir 74 with reservoir walls 76. A terminal injection chamber 78 is located within reservoir 74, and freight capsules 80 are injected or loaded into rail or tube 82 via chamber 78. Freight capsules 80 are shown in FIG. 10 in a bullet-shaped embodiment. Fluid pump means (not shown) associated with rail 82 move the transport fluid along the interior of rail 82 as indicated by arrow 84, and draw freight capsules 80 down through injection chamber 78 and into rail 82. Where water is used as the transport fluid, the water level 86 in reservoir 74 is maintained or replenished by drainage of water from another rail (not shown) which is used to transport freight capsules in the other or opposite direction, as described above, so that reservoir 74 is not emptied by the action of the fluid pump means.

Rail 82 shown in FIG. 10 generally joins up with rail 12, 14, or 16 shown in FIG. 1 through FIG. 9, so that freight capsules 80 enter into the rail system 10 after injection into rail 82 as described above.

While terminal injection system 72 is disclosed as utilizing water as transport means for freight capsules 80 along the interior of rail 82, pressurized air or gas may also be employed, as related above. In using pressurized air, a vacuum source (not shown) may be included downstream from injection chamber 78 to draw capsules 80 forward, and a blower or pressurized air source (not shown) may be utilized in a generally upstream position to push capsules 80 from behind, in the manner related above.

A plurality of injection systems 72 are generally employed with the invention, with one injection system 72 for each of the plurality of rails used for freight capsule transportation. Rail 82, after receiving freight capsules from injection system 72, generally curves upward and joins additional rails (not shown) in the manner illustrated in FIG. 8, so that a plurality of rails are then arranged for accommodating a rail car as related above.

Figure 11:
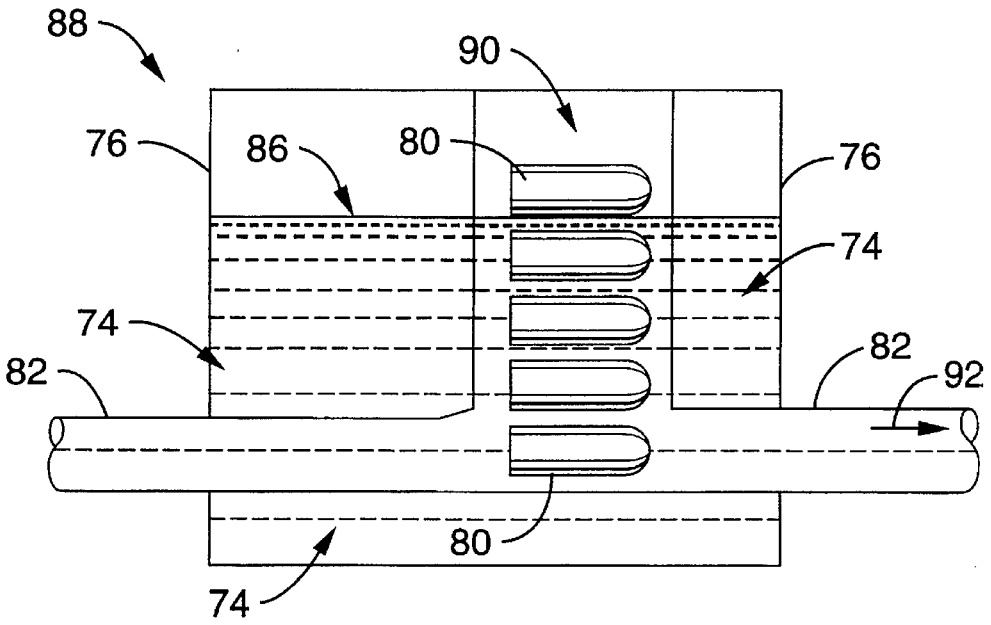
FIG. 11 is a diagrammatic side view of an intermediate freight capsule injector system in accordance with the present invention.

Referring now to FIG. 11, there is shown an intermediate injection system 88, wherein like reference numerals denote like parts. The intermediate injection system 88 may be utilized at transfer points, branches, junctions or other intermediate positions or segments in the rail system comprising the invention. Injection system 88 utilizes water or other fluids, and includes a reservoir or tank 74 with walls 76. As described above, injection system 88 may also operate with pressurized air or gas. An intermediate injection chamber 90 communicates with the interior of rail or tube 82, and a plurality of freight capsules 80 of bullet-shaped configuration are shown in injection chamber 90. Fluid pump means (not shown) associated with rail 82 move water along rail 82 in the direction indicated by arrow 92. The moving water within rail 82 serves to draw freight capsules 80 down through chamber 90 and into rail 82, as described above. The water level 86 in reservoir 74 is maintained as there is generally an equal amount of water input and output into chamber 90 and reservoir 74 from rail 96. Rail 82 generally connects with rail 12, 14, or 16 as shown in FIG. 1 through FIG. 9, so that freight capsules 80 may travel along rail system 10.

Figure 12:
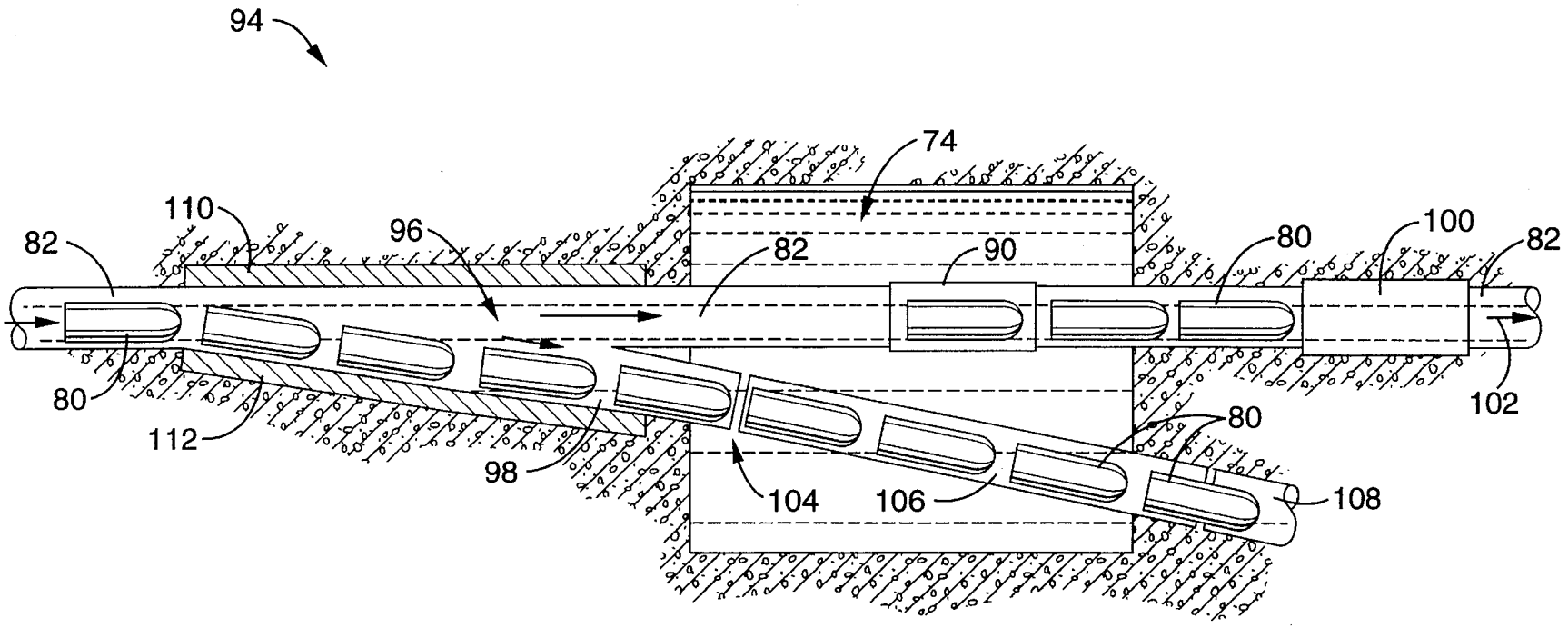
FIG. 12 is a diagrammatic side view of a rail branching or junction system in accordance with the present invention.

Referring now to FIG. 12, a junction or branching system or arrangement 94 is shown, wherein like reference numerals denote like parts, which provides for the selective removal of freight capsules from the rail at a branch point as well as the injection of additional capsules into the rail system. Generally, rail 82 empties freight capsules 80 into a widened junction area 96 from which tube 98 branches off from rail 82. Means for selectively directing capsules into tube 98 or along rail 82 are included with the junction system 94, and are discussed below. Rail 82 communicates with rail 12, 14, or 16 of FIG. 1 through FIG. 9, and receives freight capsules 80 therefrom.

Rail 82 enters a reservoir or tank 74 and interfaces with an intermediate injection chamber 90 whereby additional freight capsules 80 may be added to or placed within rail 82 as described above. Rail 82 exits reservoir 74 and communicates with a fluid pump or lim capsule pump 100 which imparts momentum to water or other fluid within rail 82 in the direction shown by arrow 102, for transporting freight capsules 80 along the interior of rail 82 to a further destination. Generally, rail 82 connects with rail 12, 14, or 16 of rail system 10 shown in FIG. 1 through FIG. 9, for travel along rail system 10 as described above.

Tube 98 terminates at tube end 104 which extends or projects into reservoir 74. Water drains from tube end 104 into reservoir 74, replenishing the water therein which is used for propelling freight capsules 80 along rail 82. Freight capsules 80 exit tube end 104 and are received by a first conveyor system 106 which conveys freight capsules 80 out of reservoir 74, and transfers the capsules 80 to a second conveyor system 108 external to reservoir 74, and hence to a terminal building (not shown) wherein capsules 80 are unloaded.

Means for selectively switching or directing capsules from rail 82 into branching tube 98 preferably comprises a first lim brancher 110 adjacent one side of junction area 96 and associated with rail 82, and a second lim brancher 112 adjacent the opposite side of junction area 96 and associated with tube 98. First and second lim branchers 110, 112 employ pressurized fluid means or magnetic means (not shown) to selectively direct freight capsules 80 along rail 82 or into tube 98. Preferably, freight capsules 80 are encoded electrically, magnetically or optically with information indicating the direction or destination of the capsules. Sensing means (not shown), which may comprise a high speed bar code scanner, magnetic strip scanner, or like sensing and detecting means, are associated with the interior of rail 80, and detect the encoded destination information on freight capsules 80 prior to the arrival of freight capsules 80 at junction area 96. A system controller (not shown), which is preferably a microprocessor or personal computer, is interfaced with the sensing means, and receives the destination code detected by the sensing means. The system controller then accordingly activates the appropriate lim brancher 110, 112 to direct the freight capsules 80 to their appropriate destinations along rail 80 or tube 98.

If capsules 80 are fabricated from magnetically attractable metal or other materials, first and second lim branchers 110, 112 may employ magnetic means to provide direction to freight capsules. For example, a plurality of electromagnets or an electromagnetic strip (not shown) may be associated with each lim brancher 110, 112, and when the sensing means indicates to the system controller that a freight capsule is to be directed along rail 82 and thus transported to a further destination, the plurality of electromagnets or electromagnetic strip along first lim brancher 110 would be activated, attracting or drawing a moving freight capsule along rail 82 and away from tube 98. If the encoded destination information on the freight capsule indicated that it had reached its destination and should be unloaded, the electromagnets or magnetic strip along second lim brancher 112 would be activated, directing the moving freight capsule towards tube 98 and to the terminal building for unloading.

Pressurized fluid means may alternatively be used with first and second lim branchers 110, 112. For example, if a freight capsule 80 is to continue along rail 82, vacuum generating means associated with first lim brancher 110 would be activated by the system controller, and pressurized gas or fluid jets along second lim brancher 112 would be activated, and the pressure differential created within junction area 96 would direct capsules 80 along rail 82. Likewise, if a freight capsule 80 is to be directed to tube 98, vacuum is applied by second lim brancher 112 and pressurized gas or fluid is applied by first lim brancher 110, and capsule 80 is directed towards tube 98 by the pressure differential within junction area 96.

Figure 13:
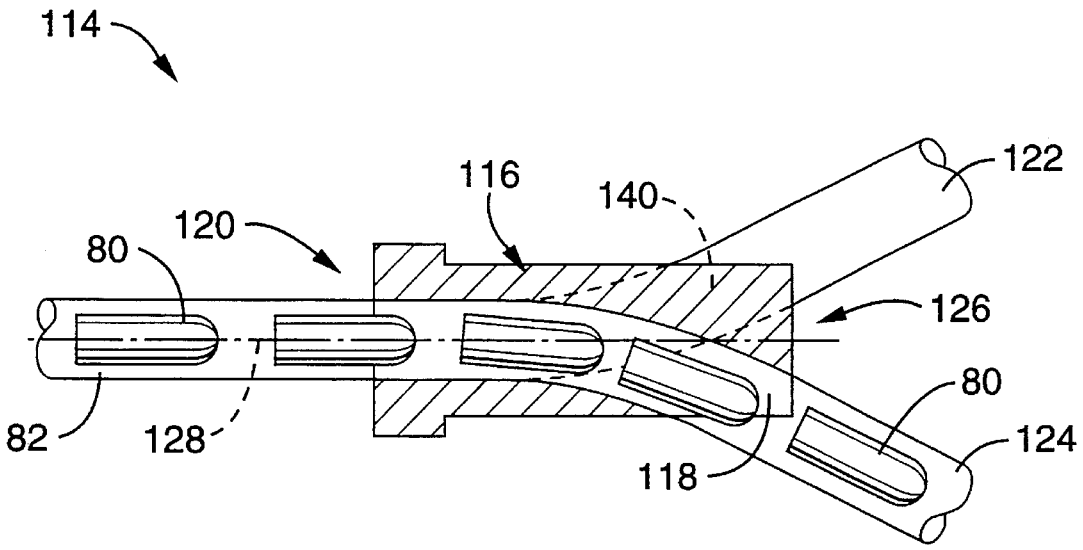
FIG. 13 is a diagrammatic side view of a freight capsule spoon diverter system in accordance with the present invention.

Referring next to FIG. 13, there is shown an alternative junction or branching system 114 as means for selectively switching or directing capsules which utilizes a rotatable spoon diverter 116 of generally cylindrical configuration and having a generally curved passage way 118 within. Rail 82 communicates with a first end 120 of spoon diverter 116, and first and second diverging tubes 122, 124 are generally adjacent to a second end 126 of spoon diverter 116. When sensing means (not shown) detect destination coding (not shown) on freight capsules 80, a system controller computer (not shown) activates rotation of spoon diverter 116 about axis 128 so that curved passage way 118 communicates with either first or second diverging tube 122, 124 according to the destination codes on the capsules 80. First and second diverging tubes 122, 124 then communicate with additional rails (not shown) for continued transportation, or direction to a terminal building (not shown) as described above for the unloading of capsules 80. Spoon diverter 116 may be utilized with water or pressurized air or other fluid as freight capsule transport means. Rotational actuation of spoon diverter 116 about axis 128 may be carried out by electric motor, pressurized fluid, or other standard means.

Accordingly, it will be seen that the present invention provides a levitated rail system with hollow, tubular rails of cylindrical configuration which allows freight capsule transport within the rails, which provides reduced aerodynamical lift forces associated with the rails, and which minimizes static wind loads experienced by the rail system. Although the description above contains many specificities, these should not be construed as limiting the scope of the invention but as merely providing illustrations of some of the presently preferred embodiments of this invention. Thus, the scope of the invention should be determined by the appended claims and their legal equivalents.

What is claimed is:

1. A levitated rail system, comprising:

(a) a plurality of cylindrical tubular rails for levitating a vehicle on the exterior of the rails, said plurality of rails parallel to each other;

(b) support means for coupling said plurality of rails to each other; and (c) base means for supporting said plurality of rails from the ground; and (d) pressurized fluid means for driving a freight capsule within at least one of said tubular rails.

2. A levitated rail system as recited in claim 1, further comprising at least one freight capsule associated with said pressurized fluid means.

3. A levitated rails system as recited in claim 1, further comprising at least one car, said car structured and configured to ride on said plurality of rails.

4. A levitated rail system as recited in claim 3, further comprising means for supporting said car above said plurality of rails.

5. A levitated rail system as recited in claim 1, further comprising a cat walk, said catwalk included between at least two of said plurality of rails.

6. A rail system as recited in claim 1, wherein said plurality of rails comprises:

(a) a first rail;

(b) a second rail, said second rail parallel to said first rail;

(c) a third rail, said third rail parallel to said first and second rails, said third rail positioned between said first and second rails, said third rail positioned below said first and second rails, said base means associated with said third rail; and (d) said first rail, said second rail, and said third rail forming an assembly of triangular cross section, with said third rail located at a lower apex.

7. A levitated rail system, comprising:

(a) a first cylindrical tubular rail for levitating at least a part of a vehicle on the exterior of the rail;

(b) a second cylindrical tubular rail, said second rail parallel to said first rail, said second rail coupled to said first rail;

(c) a third cylindrical tubular rail, said third rail parallel to said first rail and said second rail, said third rail positioned between said first rail and said second rail, said third rail coupled to said first rail, said third rail coupled to said second rail;

(d) base means for supporting said third rail from the ground; and (e) said first rail, said second rail, and said third rail forming an assembly of triangular cross section, with said third rail located at a lower apex; and (f) pressurized fluid means for driving a freight capsule within at least one of said rails.

8. A levitated rail system as recited in claim 7, further comprising at least one freight capsule associated with said pressurized fluid means.

9. A levitated rail system as recited in claim 7, further comprising at least one car, said car structured and configured to ride on said first and second rails.

10. A levitated rail system as recited in claim 9, further comprising means for supporting said car above said first and second rails.

11. A levitated rails system as recited in claim 7, further comprising a cat walk, said catwalk included between said first rail and said second rail.

12. A levitated rail system, comprising:

(a) a first hollow rail for levitating at least a part of a vehicle on the exterior of the rail, said first rail having a cylindrical cross section;

(b) a second hollow rail, said second rail having a cylindrical cross section, said second rail parallel to said first rail, said second rail coupled to said first rail;

(c) a third hollow rail, said third rail having a cylindrical cross section, said third rail parallel to said first rail and said second rail, said third rail positioned between said first rail and said second rail, said third rail positioned below said first rail and said second rail, said third rail coupled to said first rail, said third rail coupled to said second rail;

(d) a plurality of base members, said base members coupled to said third rail, said base members positioned to support said third rail from the ground;

(e) at least one freight capsule, said freight capsule associated with the hollow interior of at least one of said rails; and (f) pressurized fluid means for driving said freight capsule within the rail with which said freight capsule is associated.

13. A levitated rails system as recited in claim 12, further comprising at least one car, said car structured and configured to ride on said first and second rails.

14. A levitated rail system as recited in claim 13, further comprising means for supporting said car above said first and second rails.

15. A levitated rail system as recited in claim 12, wherein said freight capsule includes seal means for preventing pressurized fluid from escaping around said freight capsule when said freight capsule is traveling in said hollow interior of said rails.

* * * * *